US007385353B2

(12) United States Patent
Gamer et al.

(10) Patent No.: US 7,385,353 B2
(45) Date of Patent: Jun. 10, 2008

(54) LOW-PRESSURE DISCHARGE LAMP

(75) Inventors: Richard C. Gamer, Arlington, MA (US); Achim Hilscher, Friedberg-Stätzling (DE); Gerd H. Lieder, Reichertshausen (DE); Viktor Malik, Diedorf (DE); Thomas Noll, Kipfenberg (DE); Klaus Pankratz, Zusmarshausen (DE)

(73) Assignee: Patent-Treuhand-Gesellschaft Für Elektrische Glëhlampen mbH, Munich (DE)

( * ) Notice: Subject to any disclaimer, the term of this patent is extended or adjusted under 35 U.S.C. 154(b) by 0 days.

(21) Appl. No.: 10/586,928

(22) PCT Filed: Jul. 30, 2004

(86) PCT No.: PCT/DE2004/001709

§ 371 (c)(1),
(2), (4) Date: Aug. 24, 2006

(87) PCT Pub. No.: WO2005/074007

PCT Pub. Date: Aug. 11, 2005

(65) Prior Publication Data

US 2007/0114941 A1 May 24, 2007

(30) Foreign Application Priority Data

Jan. 29, 2004 (DE) ..... 10 2004 004655

(51) Int. Cl.
*H01J 17/20* (2006.01)
*H01J 17/30* (2006.01)

(52) U.S. Cl. ..... 313/634; 313/601; 313/637; 313/574

(58) Field of Classification Search ..... 313/627–643, 313/567, 111–117, 25–27, 318.01–318.09, 313/178; 439/615, 739; 445/24, 26, 29, 445/22

See application file for complete search history.

(56) References Cited

U.S. PATENT DOCUMENTS 2,272,486 A 2/1942 Stocker
2,306,925 A 12/1942 Aicher
2,312,246 A 2/1943 Johnson (Continued)

FOREIGN PATENT DOCUMENTS

EP 0077 7261 6/1997

(Continued)

*Primary Examiner*—Nimeshkumar D. Patel
*Assistant Examiner*—Donald L Raleigh
(74) *Attorney, Agent, or Firm*—Carlo S. Bessone

(57) ABSTRACT

The invention relates to a low-pressure discharge lamp comprising a glass discharge vessel (1) which is substantially tubular in form and which is closed in a gas-tight manner on the ends thereof, a filling consisting of an inert gas mixture and quicksilver, in addition to an optional luminous coating on the inner wall of the discharge vessel (1). Two current supply inlets are respectively melted into the two ends of the discharge vessel (1), with a helical electrode secured thereto (5). The invention is characterized in that in order to increase the switching resistance of the lamp in a cold start operation, at least one other electrode (7,8) made of a conductive material is arranged in the region between the helical electrode (5) and the connecting end of the discharge vessel (1) and one end of said other electrode (7, 8) is electrically connected to one of the two current supply inlets (3,4).

12 Claims, 1 Drawing Sheet

U.S. PATENT DOCUMENTS 3,549,937 A * 12/1970 Kenji et al. ..... 313/554
4,879,493 A * 11/1989 Mastuno et al. ..... 313/641
5,905,339 A * 5/1999 Chow et al. ..... 313/631

FOREIGN PATENT DOCUMENTS

EP 1 341 207 9/2003
JP 02086041 3/1990
JP 06229185 8/1994
JP 08 298096 11/1996
WO 2004/068532 8/2004

* cited by examiner

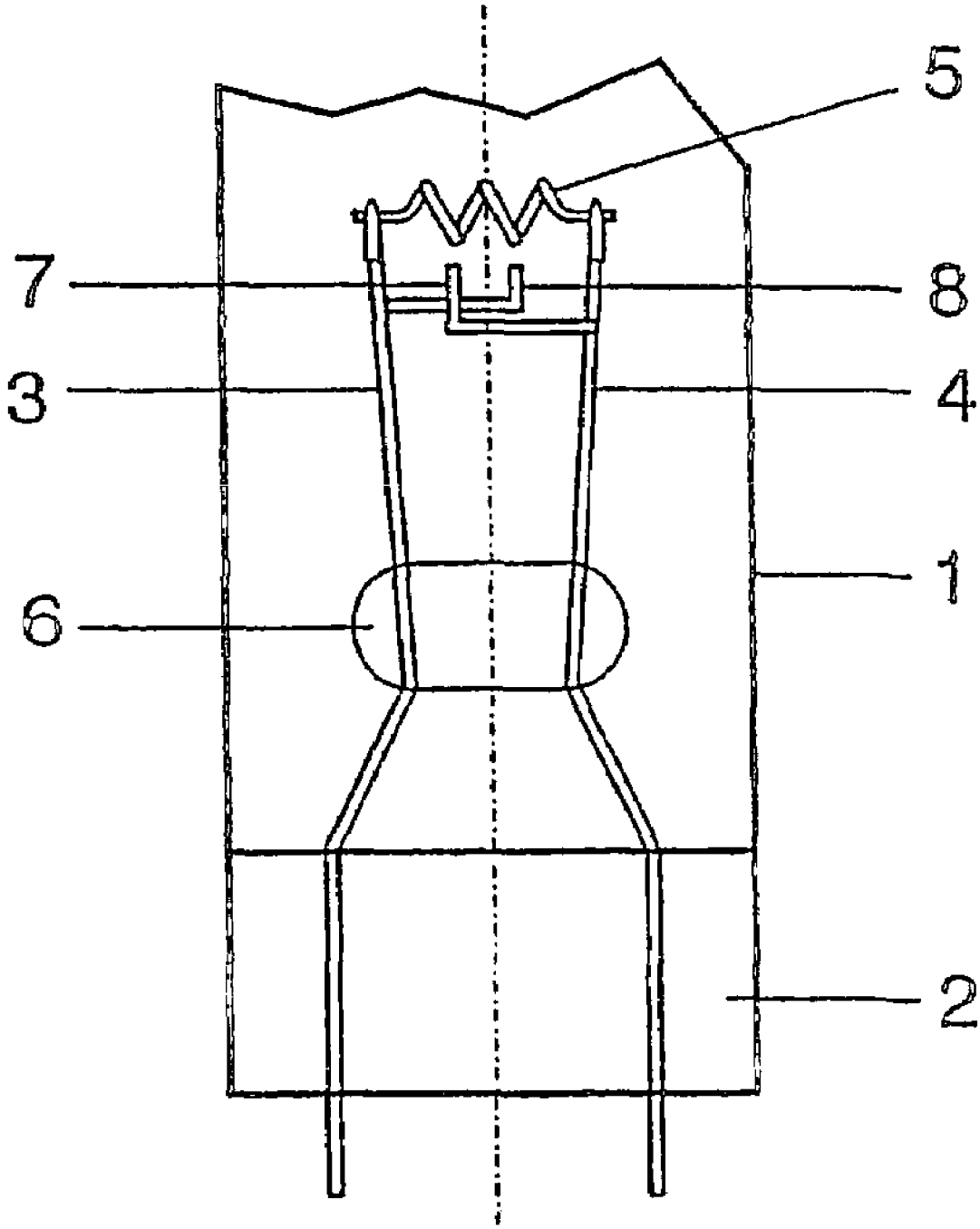
5
7
8
3
4
1
6
2

LOW-PRESSURE DISCHARGE LAMP

TECHNICAL FIELD

The invention relates to a low-pressure discharge lamp having an essentially tubular discharge vessel which consists of glass and is sealed in a gas-tight manner at the ends, having a filling comprising a noble gas mixture and possibly mercury and possibly having a fluorescent coating on the inner wall of the discharge vessel, in each case two power supply lines being fused into the two ends of the discharge vessel in a gas-tight manner and running essentially parallel to the longitudinal axis of the discharge vessel in this section, a filament electrode, which runs essentially transversely with respect to the longitudinal axis of the discharge vessel, being fixed at the inner end of each of said two power supply lines.

PRIOR ART

Coldstarting operation of low-pressure discharge lamps, i.e. operating devices for low-pressure discharge lamps which do not preheat the electrodes when starting the lamp, is becoming increasingly important. The advantage of this operation is the fact that light is output by the lamp immediately after it has been connected to the power supply system. At the same time, the ballasts for these lamps can be manufactured in a more cost-effective manner since the circuit element for the preheating is no longer required.

When coldstarting a low-pressure discharge lamp without preheating the electrodes, the lamp initially starts with a glow discharge when it is connected to the power supply system. This glow discharge with a current in the region of a few mA turns into the arc discharge after approximately from 20 to 100 ms, i.e. once the electrodes have been heated up. When the glow discharge becomes the arc discharge, the arc now attaches at the transition between the part which is not pasted with electrode material and the pasted part of the electrode since the pasted part of the electrode is still cold and is therefore nonconductive. Owing to the fact that the arc always attaches at the same point on the filament electrode each time the lamp is switched on, sputtering of electrode material takes place there and premature breakage of the electrode, in comparison with the preheated electrode, results. Even if the filament electrode is completely pasted with emitter material up to the current-carrying power supply lines, for manufacturing reasons it always still has points at which the filament has only very insufficient pasting to no pasting at all. The arc discharge will then always attach at one of these points and therefore result in a breakage of the electrode at this point owing to the sputtered electrode material.

DESCRIPTION OF THE INVENTION

The object of the present invention is to provide a low-pressure discharge lamp which has greater switching strength and therefore an extended average life in comparison with the previously known low-pressure discharge lamps in the case of coldstarting operation.

In the case of a low-pressure discharge lamp having an essentially tubular discharge vessel which consists of glass and is sealed in a gas-tight manner at the ends, having a filling comprising a noble gas mixture and possibly mercury and possibly having a fluorescent coating on the inner wall of the discharge vessel, in each case two power supply lines being fused into the two ends of the discharge vessel in a gas-tight manner and running essentially parallel to the longitudinal axis of the discharge vessel in this section, a filament electrode, which runs essentially transversely with respect to the longitudinal axis of the discharge vessel, being fixed at the inner end of each of said two power supply lines, this object is achieved by the fact that, in order to increase the switching strength of the lamp during coldstarting operation, at least one further electrode consisting of a conductive material is arranged in the region between the filament electrode and the adjoining end of the discharge vessel, one end of this further electrode being electrically connected to one of the two power supply lines.

This additional electrode is used as a sacrificial electrode since this is an electrode which is available to the arc discharge for the attachment of the arc when the arc discharge is established, in which case it is insignificant whether material of this electrode is sputtered in the process. Firstly, the arc discharge attaches to this sacrificial electrode and transfers to the filament electrode when the emitter material on the filament electrode has been heated up by means of ion bombardment to such an extent that it is sufficiently hot for the thermal emission of electrons.

Since the filament electrode needs to be heated up to the required operating temperature of approximately 900 to 1500 K even when a further electrode is used which acts as the sacrificial electrode, and this can only be achieved with sufficient speed by means of ion bombardment, the ion bombardment must not be completely prevented on the filament electrode. In order, on the other hand, to keep the sputtering of electrode material from the filament electrode low, the further electrode needs to be fitted geometrically in relation to the filament electrode such that the plasma density on the filament electrode is substantially reduced in comparison with the case without an additional electrode, i.e. by a factor of approximately 100. In order to achieve this, the further electrode is advantageously fitted such that, in a vertical view of the plane formed by the two power supply lines and the filament electrode, it lies largely between the two power supply lines.

The potential difference between the plasma on the filament electrode $V_{NE}$ and on the further sacrificial electrode $V_{SE}$ is $$\Delta V_P = V_{NE} - V_{SE} \sim T_e \ln\left(\frac{n_{P,NE}}{n_{P,SE}}\right),$$

where $T_e$ is the electron temperature, $n_{P,NE}$ is the plasma density at the location of the filament electrode and $n_{P,SE}$ is the plasma density at the location of the further electrode. The energy of the ions which impinges on the filament electrode and the further electrode is therefore approximately equal in size; however, owing to the low plasma density $n_{P,NE}$ at the location of the filament electrode, a reduced ionic current impinges on the filament electrode, which reduces the sputtering rate and therefore extends the life of the filament electrode during coldstarting.

In order to facilitate the attachment of the arc discharge to the further electrode, the conductive material of the electrode has a high coefficient for secondary electron emission. Investigations with different materials have shown that, in particular, nickel and/or ruthenium or else tungsten are suitable for this purpose. On the other hand, molybdenum, which should likewise be very well suited owing to its high secondary electron emission coefficient, has not proven to be suitable, which until now has not been understood.

Further investigations have shown that the switching strength of the lamp during coldstarting operation increases with the decreasing diameter of the further electrode. In this case, however, the electrode still needs to have a sufficiently large diameter that it maintains sufficient stability over the life of the lamp. For this reason, the further electrode advantageously comprises a wire having a wire diameter of between 50 and 150 μm.

For good secondary electron emission, the further electrode should be arranged as close as possible to the filament electrode. It is particularly appropriate in this regard that the further electrode extends essentially parallel to the axis of the filament electrode from the power supply line to which it is electrically connected in the direction of the other power supply line. Particularly advantageous results are obtained as regards the arc attachment on the further electrode if the electrode extends for 40 to 60% of the distance between the two power supply lines in the direction of the other power supply line. Since, after firing of the lamp, the electrical field at the additional electrode preferably runs parallel to the axis of the discharge vessel, it is advantageous if part of the additional electrode points in this direction in order to keep the glow discharge on the additional electrode. For this reason, the free end of the further electrode is bent back in the direction of the filament electrode.

A favorable distance between the axis of the filament electrode and the free end or tip of the additional electrode depends essentially on the inner diameter of the discharge vessel in this region. If the glow discharge attaches at the additional electrode, a negative glow-discharge light forms around this electrode, this negative glow-discharge light being of the order of magnitude of half the inner diameter of the discharge vessel. The cathode drop area forms directly at the surface of the further electrode. Adjacent to the cathode drop area, the plasma density in the negative glow-discharge light rises steeply in order to markedly drop after a maximum until the level of the positive column at the end of the negative glow-discharge light is reached. Therefore, the free end of the further electrode (7, 8) preferably has a distance of $(0.2-1)\times R_{inner\ tube}$ from the filament electrode (5), $R_{inner\ tube}$ being the inner radius of the discharge vessel in this section of the discharge vessel.

Furthermore, the further electrode (7, 8) can advantageously be fixed to the power supply line in a position in which it is rotated through an angle of less than or equal to 45° in relation to the axis of the filament electrode. This favors firing of the glow discharge at the sacrificial electrode since the initial electron avalanche takes place from the electrode to the wall of the discharge vessel. The closer the sacrificial electrode gets to the wall of the discharge vessel, the more probable it is that the glow discharge will be ignited at the sacrificial electrode.

A further improvement in the switching strength and therefore the average lamp life during coldstarting operation is achieved if the lamp has two further electrodes instead of one further electrode as the sacrificial electrode, in each case one end of each further electrode being connected to one of the two power supply lines of the same filament electrode such that a further electrode is electrically connected to each of the two power supply lines.

BRIEF DESCRIPTION OF THE DRAWINGS

The invention will be explained in more detail below with reference to the following exemplary embodiment.

PREFERRED EMBODIMENT OF THE INVENTION

The FIGURE shows one end of a compact low-pressure discharge lamp according to the invention having a power consumption of 21 W. The multiply wound discharge vessel 1 comprises three discharge vessel parts which are bent in the form of a U and have a tube outer diameter of 12 mm, which discharge vessel parts are connected by transverse fuse seals to form a coherent discharge path. The two ends of the discharge vessel are sealed in a gas-tight manner by a pinch seal 2. Two power supply lines 3, 4 consisting of Fe—Ni—Cr wire having a wire diameter of 400 μm are fused in a gas-tight manner into each of these pinch seals and bear a filament electrode 5 consisting of double-wound tungsten wire at their inner end. The two power supply lines 3, 4 are in addition held, by means of a glass bead 6, in the center between the filament electrode 5 and the pinch seal 2 into which they are fused.

According to the invention, in the case of the one end of the discharge vessel 1 which is shown here, in each case a further electrode 7, 8 is fitted as the sacrificial electrode between the glass bead 6 and the filament electrode 5 on the two power supply lines 3, 4. The two further electrodes 7, 8 comprise a nickel wire having a wire diameter of 125 μm. They extend away from the power supply lines 3, 4 parallel to the axis of the filament electrode 5 and are bent back at right angles to the filament electrode 5 at their end. There is a distance of 1.25 mm between the tips of the further electrodes 7, 8 and the filament electrode 5. Those sections of the further electrodes 7, 8 which are parallel to the filament electrode 5 have a length of 3 mm; they are in each case welded to the opposite side of the respective power supply line 3 or 4 and therefore do not come into contact with one another.

Measurements show that, owing to the design of the above-described compact low-pressure discharge lamp with two further electrodes as sacrificial electrodes, it is possible to achieve an increase in the average number of switching operations by 10 000 switching operations, i.e. connections to the power supply system, during coldstarting operation in comparison with an identical lamp without these further electrodes.

The invention claimed is:

1. A low-pressure discharge lamp having an essentially tubular discharge vessel (1) which consists of glass and is sealed in a gas-tight manner at the ends, having a filling comprising a noble gas mixture and possibly mercury and possibly having a fluorescent coating on the inner wall of the discharge vessel (1), in each case two power supply lines (3, 4) being fused into the two ends of the discharge vessel (1) in a gas-tight manner and running essentially parallel to the longitudinal axis of the discharge vessel (1) in this section, a filament electrode (5), which runs essentially transversely with respect to the longitudinal axis of the discharge vessel, being fixed at the inner end of each of said two power supply lines (3, 4), characterized in that, in order to increase the switching strength of the lamp during coldstarting operation, at least one further electrode (7, 8) consisting of a conductive material is arranged in the region between the filament electrode (5) and the adjoining end of the discharge vessel (1), one end of this further electrode (7, 8) being electrically connected to one of the two power supply lines (3, 4), the free end of the further electrode (7, 8) has a distance of $(0.2-1)\times R_{inner\ tube}$ from the axis of the filament electrode (5), $R_{inner\ tube}$ being the inner radius of the discharge vessel (1) in this section of the discharge vessel (1).

2. The low-pressure discharge lamp as claimed in claim 1, characterized in that, in a vertical view of the plane formed by the two power supply lines (3, 4) and the filament electrode (5), the further electrode (7, 8) lies largely between the two power supply lines (3, 4).

3. The low-pressure discharge lamp as claimed in claim 1, characterized in that the conductive material of the further electrode (7, 8) has a high coefficient for secondary electron emission.

4. The low-pressure discharge lamp as claimed in claim 1, characterized in that the conductive material of the further electrode (7, 8) is nickel and/or ruthenium.

5. The low-pressure discharge lamp as claimed in claim 1, characterized in that the conductive material of the further electrode (7, 8) is tungsten.

6. The low-pressure discharge lamp as claimed in claim 1, characterized in that the further electrode (7, 8) comprises a wire.

7. The low-pressure discharge lamp as claimed in claim 6, characterized in that the wire has a wire diameter of between 50 and 150 μm.

8. The low-pressure discharge lamp as claimed in claim 1, characterized in that the further electrode (7, 8) extends essentially parallel to the axis of the filament electrode (5) from the power supply line (3, 4) to which it is electrically connected in the direction of the other power supply line (3, 4).

9. The low-pressure discharge lamp as claimed in claim 8, characterized in that the further electrode (7, 8) extends from the power supply line (3, 4) to which it is electrically connected for 40 to 60% of the distance between the two power supply lines (3, 4) in the direction of other power supply line (3, 4).

10. The low-pressure discharge lamp as claimed in claim 1, characterized in that the free end of the further electrode (7, 8) is bent back in the direction of the filament electrode (5).

11. The low-pressure discharge lamp as claimed in claim 1, characterized in that the further electrode (7, 8) is fixed to the power supply line in a position in which it is rotated through an angle of less than or equal to 45° in relation to the axis of the filament electrode.

12. The low-pressure discharge lamp as claimed in claim 1, characterized in that the lamp has two further electrodes (7, 8), in each case one end of each further electrode (7, 8) being connected to one of the two_power supply lines (3, 4) of the same filament electrode (5) such that a further electrode (7, 8) is electrically connected to each of the two power supply lines (3, 4).

* * * * *